US007327109B1

(12) United States Patent
Hagen

(10) Patent No.: US 7,327,109 B1
(45) Date of Patent: Feb. 5, 2008

(54) ADJUSTABLE BRIDGE FOR ACOUSTIC STRINGED INSTRUMENTS

(75) Inventor: John Hagen, 718 Benton Ct., Lake Villa, IL (US) 60046

(73) Assignee: John Hagen, Lake Villa, IL (US)

( * ) Notice: Subject to any disclaimer, the term of this patent is extended or adjusted under 35 U.S.C. 154(b) by 0 days.

(21) Appl. No.: 11/318,985

(22) Filed: Dec. 27, 2005

Related U.S. Application Data

(60) Provisional application No. 60/646,413, filed on Jan. 20, 2005.

(51) Int. Cl.
*G10D 3/04* (2006.01)

(52) U.S. Cl. ..... 318/298; 84/299

(58) Field of Classification Search ..... 84/298, 84/299

See application file for complete search history.

(56) References Cited

U.S. PATENT DOCUMENTS 615,053 A * 11/1898 Utt ..... 84/299
1,375,069 A * 4/1921 Turgeon ..... 81/20
1,388,539 A * 8/1921 White ..... 403/249
1,595,798 A * 8/1926 Pasquale ..... 84/299
2,226,067 A * 12/1940 Morgan ..... 285/295.3
2,257,169 A * 9/1941 Hopps ..... 407/49
2,407,101 A * 9/1946 Rosenboom ..... 144/205
2,449,449 A * 9/1948 Ettore ..... 409/236
2,491,788 A 12/1949 Widowson
2,634,062 A * 4/1953 Forman ..... 241/239
2,996,158 A * 8/1961 Greenleaf ..... 403/370
3,065,820 A * 11/1962 Prizler et al. ..... 182/93
3,290,980 A * 12/1966 Fender ..... 84/307
4,062,598 A * 12/1977 Magnuson ..... 305/42
D265,835 S * 8/1982 Rickard ..... D17/21
4,430,919 A * 2/1984 Matsui ..... 84/299
4,625,613 A * 12/1986 Steinberger ..... 84/298
4,649,789 A * 3/1987 Wadatsu ..... 84/298
4,768,414 A * 9/1988 Wheelwright ..... 84/298
4,911,055 A 3/1990 Cipriani
4,951,543 A 8/1990 Cipriani
5,052,260 A * 10/1991 Cipriani ..... 84/298
5,152,629 A * 10/1992 Di Vittorio ..... 403/248
5,208,410 A * 5/1993 Foley ..... 84/307
5,347,905 A * 9/1994 Cipriani ..... 84/298
5,355,759 A 10/1994 Hoshino
5,404,783 A * 4/1995 Feiten et al. ..... 84/298
5,600,078 A * 2/1997 Edwards ..... 84/307
5,600,079 A 2/1997 Feiten
5,750,910 A * 5/1998 LoJacono ..... 84/314 N
6,031,165 A * 2/2000 Brekke ..... 84/298
6,124,536 A 9/2000 Hoshino
6,297,434 B1 * 10/2001 Martello ..... 84/298
6,508,715 B1 * 1/2003 Jensen ..... 470/129
6,806,411 B1 * 10/2004 Allen ..... 84/454
6,875,910 B2 * 4/2005 Naimish ..... 84/298
6,884,176 B2 * 4/2005 Jensen ..... 470/121

OTHER PUBLICATIONS

Brian Yarosh Adjustable Saddles for—Acoustic Guitars American Lutherip No. 82/Summar 2005.

* cited by examiner

*Primary Examiner*—Lincoln Donovan
*Assistant Examiner*—Robert W. Horn

(57) ABSTRACT

A bridge for providing adjustable active string length on acoustic stringed musical instruments comprised of a concavity surrounding a plurality of individually adjustable saddles that are arranged individually and independently to support each string and be freely moveable into position by an adjustment screw to obtain the harmonic at the 12th fret, and then can be locked in place by action of a contiguous wedge that causes firm contact between the saddles and lateral sides of the concavity.

1 Claim, 10 Drawing Sheets

ADJUSTABLE BRIDGE FOR ACOUSTIC STRINGED INSTRUMENTS

CROSS-REFERENCE TO RELATED APPLICATIONS

This application claims the benefit of provisional patent application Ser. No. 60/646,413, filed Jan. 20, 2005 by the present inventor.

FEDERALLY SPONSORED RESEARCH

Not Applicable

SEQUENCE LISTING OR PROGRAM

Not Applicable

BACKGROUND OF INVENTION

1. Field of Invention

This invention relates to adjustable guitar structures and their construction, specifically to provide a method to accurately intonate acoustic guitars.

2. Prior Art

Typically stringed instruments of this type are composed of a series of strings that are strung under tension over a fret board being supported by a nut and saddle or saddles of the bridge. The frets are affixed to the fret board and occupy intermediate positions between the nut and saddle and are used as temporary points of string support to obtain higher frequency tones. To utilize the frets the strings are displaced until contact occurs with the fret. In guitars proper tonal quality is obtained when the strings are tensioned and supported to produce the tonal harmonic at the 12th fret, i.e., correct intonation. To achieve this guitars are proportioned so that the distance to the 12th fret from the nut is approximately equal to the distance from the 12th fret to the saddles. In practice many factors enter into gaining the location to produce the harmonic. These factors fall into several general categories; those governing the vibration of the strings, and those involved in transmitting the vibrational energy to the guitar's top (sound board). The factors governing string frequency is: tension, active string length, and linear density of the string. Transmission of vibrational energy is affected by the material and mechanical composition of the bridge and saddle(s).

Conventional guitar construction utilizes a straight saddle positioned to produce correct intonation for the high and low E strings using what the manufacturer considers to be an "average string." The remaining strings seldom if ever achieve the precise degree of intonation that produces optimal sound characteristics. Moreover, a multitude of string types are available, each type possessing differing material compositions and gauges producing unique linear densities and tension requirements. Players possessing refined musical abilities generally have strong personal preferences as to how their instruments sound and play. To achieve these preferences they frequently select strings that are different than those the instrument comes outfitted with and adjust the action, i.e., the string height above the fret board to complement their playing style. Thus, it becomes problematic whether even the high and low E strings will have good intonation.

In the case of professional artists who play in studio settings and groups, precise intonation becomes crucial to the production of high quality performance. Moreover, these musicians frequently travel to perform in different climatic zones which causes their instruments to de tune and require adjustment of the intonation. Furthermore, airplane travel further exacerbates these problems because of the rapid changes in pressure and altitude. Therefore, individual adjustability of string intonation is a desirable feature to provide a means to compensate for all the factors that degrade the sound quality of acoustic guitars. Thus, a need exists for an improved construction of an adjustable intonation apparatus to properly intonate acoustic guitars. The adjustable acoustic guitar bridge claimed here in provides a means to precisely and easily adjust individual string intonation without negatively affecting the sonority of the instrument.

Attempts have been made to produce a device to properly intonate acoustic guitars, none of which has proven to have any significant degree of commercial viability. In the 1960's attempts were made by Gibson® with the Dove® acoustic guitar by putting their Nashville Tune-o-Matic® electric guitar bridge on an acoustic instrument without success. While adjustable electric guitar bridges theoretically allow an acoustic guitar to be properly intonated, typically the construction employed relies on an adjustment screw running through the metal saddle, with the screw connected at both ends, or a screw loaded with a spring between the saddle and screw to help stabilize the saddle. The type of construction described above is not adaptable to acoustic guitars because the transmission of string vibration is dampened resulting in diminished sustain (sound duration), sonority, and amplitude. Moreover, the metal parts in electric guitar bridges used to support the string are not acoustically resonant producing an undesirable thin brittle tone.

In the 1970's a compensated acoustic guitar bridge was developed which divided the slanted saddle into multiple segments that would provide a finer fit to individual string length requirements for better intonation. The most effective variety of this system of compensation utilized an individual saddle for each string that occupied fixed positions within the bridge structure. The location for each saddle position was derived for a particular string type selected by the player and was set up under "average" environmental conditions, i.e., using an environment controlled for humidity and temperature. Since this style of bridge is not adjustable it has many of the draw backs listed above.

Thereafter, inventors created a number of adjustable bridges for acoustic guitars. U.S. Pat. Nos. 6,124,536 to Hoshino (2000); 3,290,980 to Fender (1966) show bridge systems with saddles that are freely adjustable along the longitudinal axis of the strings. Adjustment of the saddles was accomplished by utilizing screws, the heads of which are restrained in position by passing through a hole located in a traverse boss on the posterior portion of the bridge or saddle mechanism with a similar boss that is mounted to a bridge. Typically the male threads of the screws engage sales that contain a threaded hole, allowing fine adjustment of the saddles location by rotating the screw. Free movement requires the various parts of the saddle traverse mechanism to incorporate clearances (spaces between the parts) to function. The clearances between the parts not only allows movement of the parts in the intended manner for string length adjustment, but also an undesired movement imparted by the vibration of the string. The undesirable vibration of the parts originating from string vibration uses sting energy, thereby, reducing the available energy for sound generation, resulting in a diminished sound amplitude potential for the instrument.

Cipriani, in U.S. Pat. No. 4,911,055 (1990) describes an adjustable bridge system with individually moveable saddles that incorporate a toothed bottom that engage a mating toothed surface incorporated upon the upper surface of a bridge base plate. The saddles are adjusted by moving them by hand to the nearest set of teeth to the desired saddle position on the corresponding bridge base plate, then passing the string over the saddle and utilizing its tension to maintain the saddle in the selected position. In this case the saddle position is incrementally adjustable and does not provide the degree of precision obtainable with a system that is continuously adjustable. Moreover, a significant probability would exist that the saddles could be dislodged from their positions when replacing worn out strings, which requires the removal of old strings and replacing them with new strings.

Widowson, in U.S. Pat. No. 2,491,788 (1949) depicts an adjustable bridge saddle system that incorporates a bridge, saddle platform, and longitudinally moveable saddles that are retained in position by a system of clamps. This system relies on the saddles to simply be moved into position by hand. While simple it does not provide the means of easily and precisely moving the saddle an exact amount as is possible with a system that is actuated by a screw.

More recently Yarosh published a design in the Journal of American Lutherie Number 82/Summer 2005 derived from Rodriguez's system as described in his book The Art and Craft of Making Classical Guitars (1960) which utilizes individual saddles mounted on wood blocks retained in lateral position by mating inwardly slanting slots (dovetailed slots) in the wood bridge. These slots are elongated parallel to the direction of the strings long axis allowing longitudinal adjustment. Adjustment of the saddle position is achieved by sliding the moveable saddle blocks in the elongated slots to the desired location and relying on string tension to maintain their position. Yarosh's design works in the same manner as Rodriguez's design but uses slots with vertical walls instead of the slanted dovetail, relying on the downward pressure of the string to retain the saddles in the bridge slots as well as their longitudinal position. Environmental factors, particularly humidity have significant effects upon wood, greater humidity causing expansion and lower humidity contraction. Thus, climate and weather conditions which affect humidity would cause variation in the size of the slots that retain the saddles. Thus, the wood expansion caused by elevated humidity would produce a reduction in the width of the saddle retention grooves, causing the saddles to be firmly gripped making movement for adjustment of saddle position difficult or impossible. Conversely, a lower level of humidity would cause shrinkage of the wood producing excessive clearance between the slots and the saddles. This would allow the saddles to become loose enabling the saddles to change position or even fall out during string changes. Moreover, under dry conditions the excessive saddle to slot clearance would allow the negative effects caused by string imparted saddle vibration as described above. A final problem with this design is the same difficulty of easily and precisely positioning the saddles as already described for Widowson's design.

The patents already mentioned, i.e., by Hoshino, Fender, and Widowson also have saddle geometries that can be characterized as having restricted string contact areas. This not a problem as long as the bridge unit is designed for instruments within a narrow range of string spacings. However, fretted string instruments are available in many neck widths producing differing angular string spreads that produce variation in the spacing of the strings when they pass over the saddles of the bridge. To accommodate string spread variation these designs would have to be produced in many size variants, making them from a manufacturing perspective less desirable than a system that is able to accommodate a wider range of string Spacings.

OBJECTS AND ADVANTAGES

An object of this invention is to provide a bridge system in which an assembly of finely adjustable saddles incorporated in a housing can be stabilized in position to provide precise intonation.

A further object of the invention is to efficiently transfer string vibrational energy to the sound board to create increased volume and sustain.

Another object is to preserve the sonority of the instrument by utilizing acoustically resonant materials to transmit string vibration to the sound board of the instrument.

A further object of this invention is to provide a mechanism that can be easily retrofitted into existing instruments as well as being incorporated in newly manufactured instruments.

Another objective is to produce a device whose appearance is not radically different from conventional bridges for market acceptance.

Still further objects and advantages will become apparent from a consideration of the ensuing description and drawings.

SUMMARY

The present invention overcomes the problems of the prior art as noted above, by providing a plurality of individual precisely adjustable saddles actuated by floating internal screws and stabilized in place by a wedge, thereby, providing a means to achieve optimum intonation and an increased transfer of vibrational string energy to the sound board while maintaining sonority.

The invention consists of a concave housing where in the saddles, saddle adjustment screws, wedge, and wedge tensioning screw are retained.

DRAWINGS

Figures

In the drawings, closely related figures have the same number but different alphabetic suffixes.

DRAWINGS-Reference Numerals

| | | | |
|---|---|---|---|
| 12. | Body | 13. | Soundboard |
| 14. | Sound hole | 15. | Bridge |
| 16. | Saddle housing | 17. | Saddle |
| 18. | Nut | 19. | Saddle screw |
| 20. | Tuning machine | 21. | Fret |
| 22. | Head | 23. | String |
| 24. | Fret Board | 25. | Guitar |
| 26. | Tensioning screw | 27. | Actuator wedge |
| 28. | Threaded hole | 29. | Access hole |
| 30. | Threaded hole | 31. | Bridge pin hole |
| 32. | Bridge pin | 33. | Screw cavity |
| 34. | Gap | 35. | Bridge cavity |
| 36. | Bridge base | 37. | 4 sided saddle housing |
| 39. | Threaded hole | | |

DETAILED DESCRIPTION

FIG. 1 through FIG. 7

Preferred Embodiment

Figure 1:
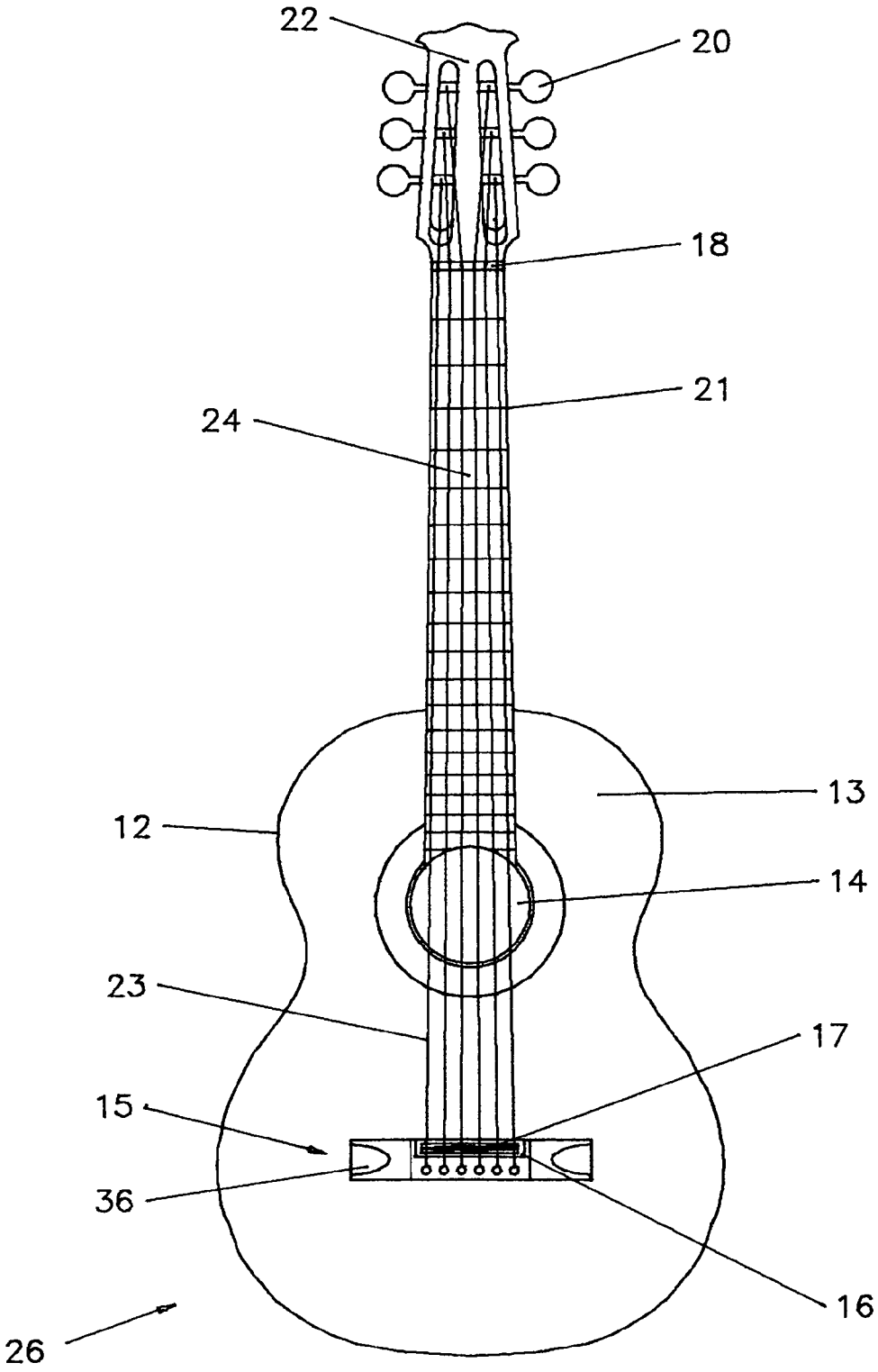
FIG. 1 is a top plan view of a conventional flat top guitar with a bridge and saddle assembly constructed in accordance with the invention.

FIG. 1 shows the basic configuration of a conventional steel sing flat top acoustic guitar 25 having a guitar body 12 having a top or sound board 13 on which is mounted a bridge 15 below the sound hole 14. Guitar strings 23 anchored in the bridge 15 stretch over the saddles 17, the resonant cavity, and on to the head 22 and tuning machines 20. A bridge 15 and a saddle housing 16 containing moveable saddles 17 is mounted on the top 13 of the guitar body 12. Upraised metal ridges called frets 21 are located at designated intervals on the fret board 24 perpendicular to the strings. A typical guitar has about 20 frets. The theoretical placement of the frets are located conventionally, being sequentially derived from the logarithmic decrement of the 12th root of 2 for the desired scale length.

Figure 2:
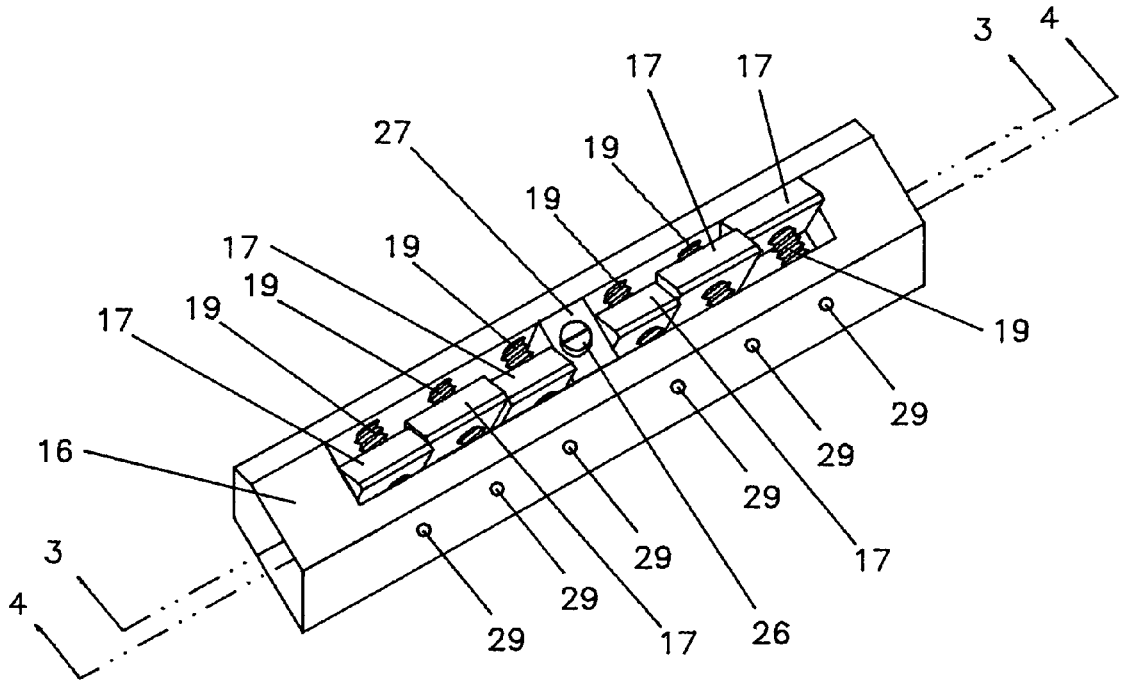
FIG. 2 Shows a front perspective view (from above) of the invention showing a housing, saddles, saddle adjustment screws, wedge, wedge screw, and saddle screw adjustment access holes.
Figure 3:
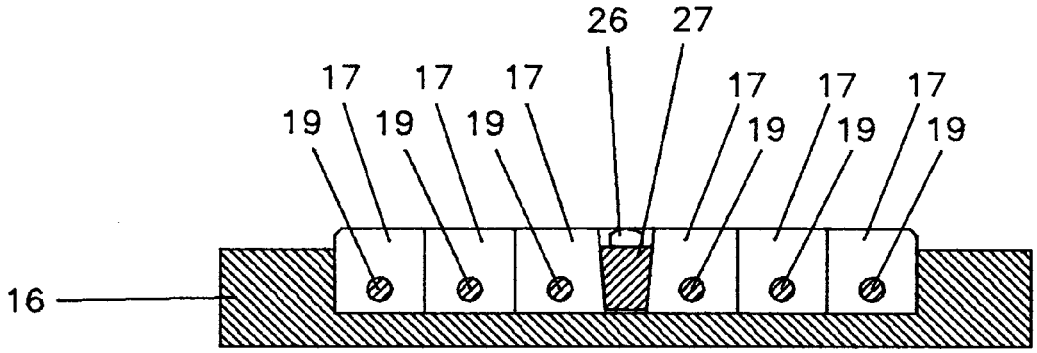
FIG. 3 Is a sectional front side view of the invention with the sectioning plane passing between the front housing wall and saddles depicting the wedge and saddles in the locked position.
Figure 3A:
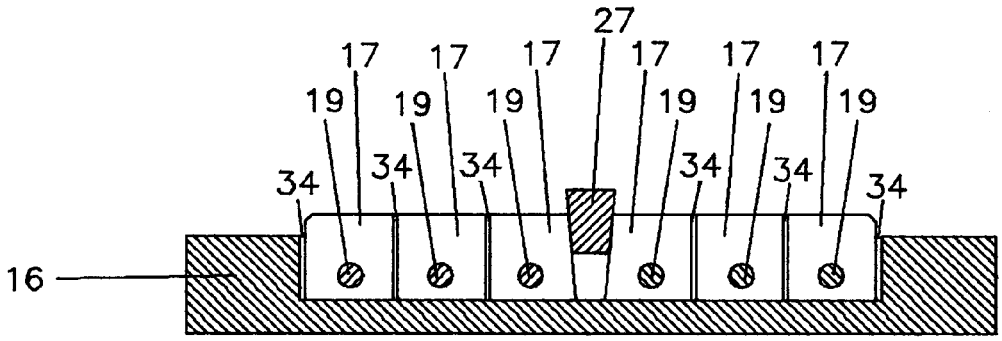
FIG. 3A Is the same sectional front side view as in FIG. 3 but showing the tensioning wedge positioned to allow clearance to form between adjacent parts.
Figure 3B:
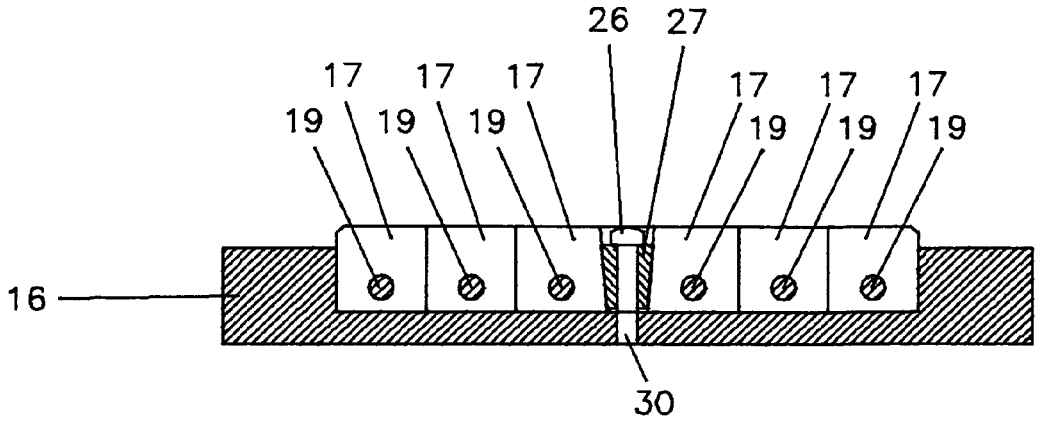
FIG. 3B Is a sectional front side view showing the threaded hole in the basal portion of the bridge housing.

FIG. 2 shows a front perspective view from above of the preferred embodiment of the invention. The bridge utilizes individual saddles 17 which are retained in position by a saddle housing 16 and each are independently adjustable in a direction along the longitudinal axis of the strings 23. Each saddle has a threaded hole through which a adjustment screw 19 passes which provides saddle retention and alignment as well as longitudinal adjustment. Longitudinal adjustment is accomplished by use of a tool inserted through a screw access hole 29 to rotate the saddle adjustment screw 19. A actuator wedge 27 provides a saddle tensioning system by biasingly urging the saddles apart (FIG. 3) by rotatably tensioning screw 26 which passes through actuator wedge 27 in to mating threaded hole 30 (FIG. 3B) in the basal portion of saddle housing 16, producing firm contact between each saddle and the end surfaces of the saddle housing, retaining all the saddles in position. When the actuator wedge is partially withdrawn (FIG. 3A) the lateral tension is relaxed producing gaps 34 between the parts allowing freedom of saddle movement for adjustment.

Figure 4:
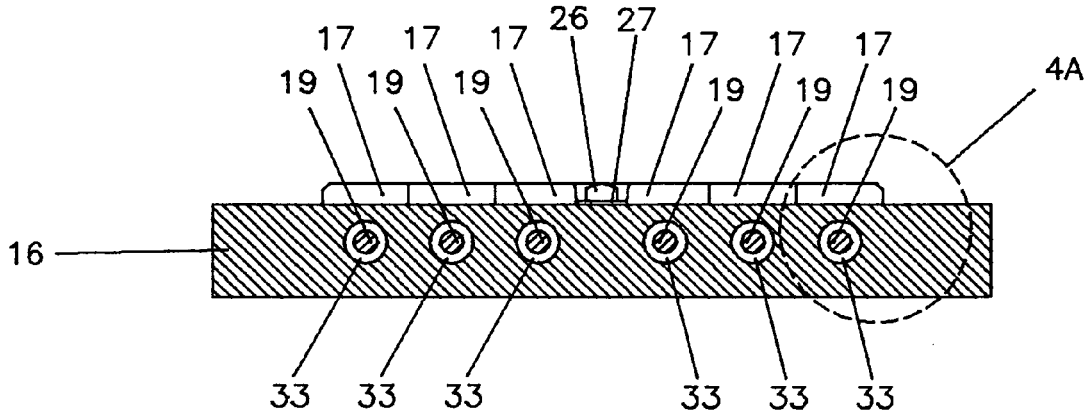
FIG. 4 to FIG. 4C Are sectional front side views of the invention with the sectioning plane passing through the front wall of the housing depicting the affects of various wedge positions on the relative positions of the ends of the saddle adjustment screws and the housing cavities.
Figure 4A:
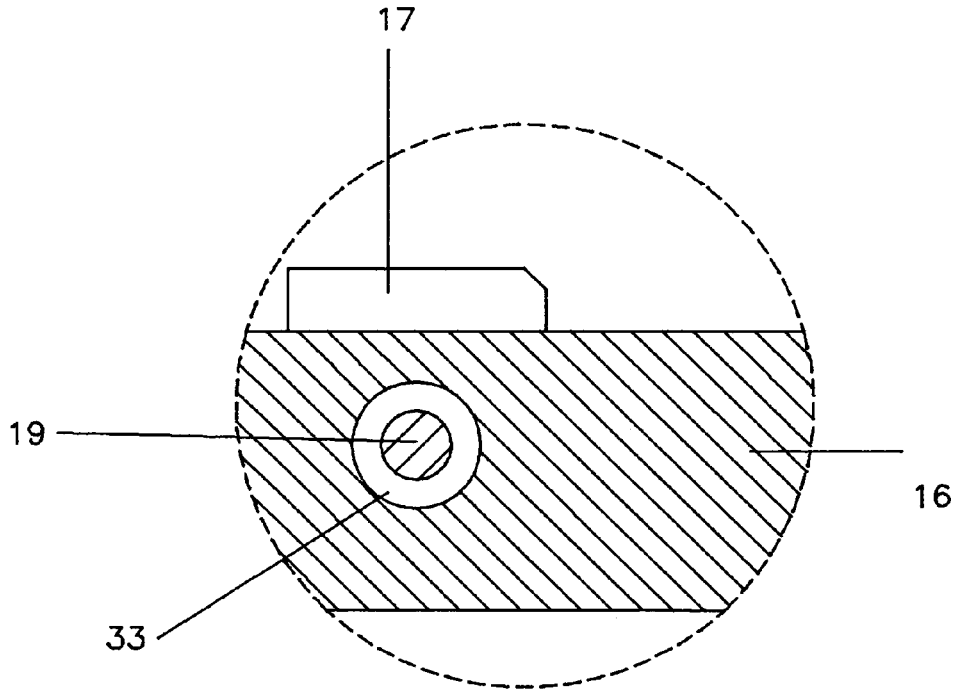
Figure 4B:
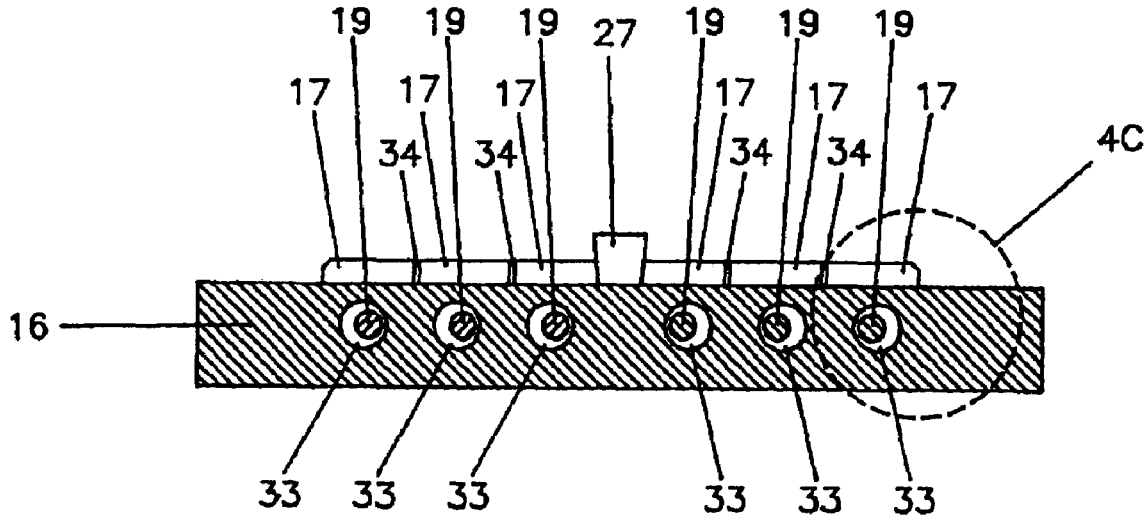
Figure 4C:
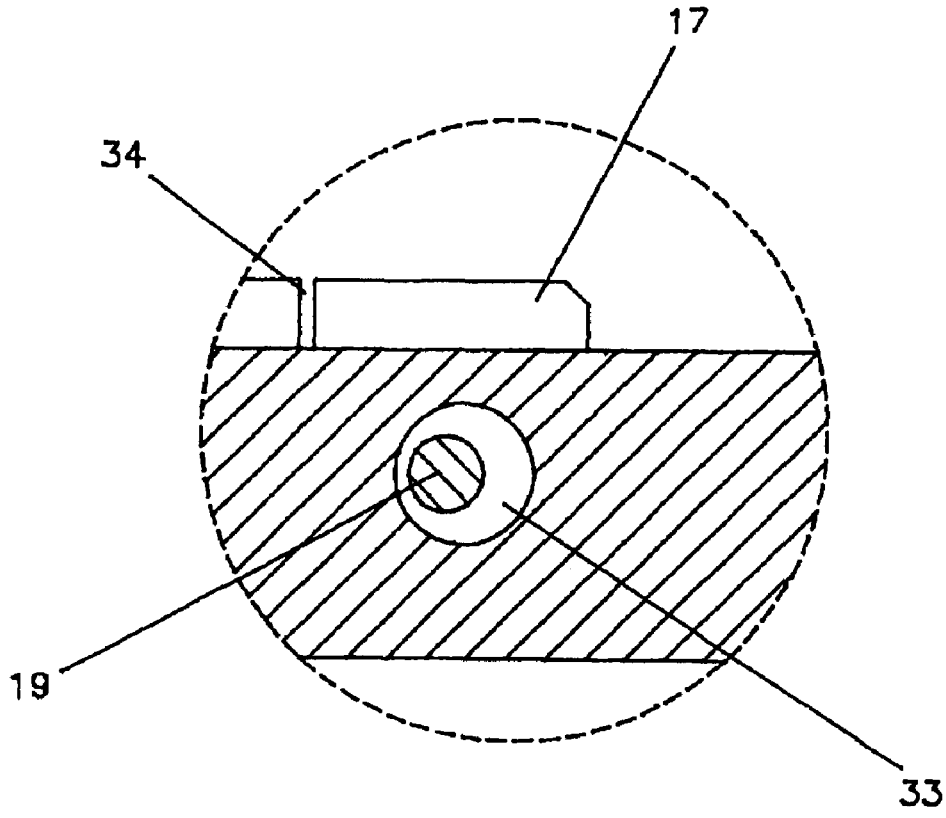

FIGS. 4 to 4C is a front sectional view where the sectioning plane is passing through the front housing wall positioned to show where the capacity for lateral movement of the saddles originates permitting the saddles to be retained in fixed positions or free to move for adjustment. FIG. 4 shows the relative size and positions of each individual saddle screw 19 and their associated housing screw cavities 33 for a complete assembly that is retained in fixed positions with the actuator wedge tensioned by screw 26. FIG. 4A shows how acoustic isolation of the saddle screws 19 is achieved by saddles 17 in which they are mounted, being centrally positioned in the housing screw cavities 33 producing a gap between the two, thereby, eliminating contact between the saddle screw and the saddle housing. In FIG. 4B the actuator wedge 27 has been partially withdrawn removing the lateral tension from the saddles 17 and their associated saddle screws 19 allowing them to become loose. The expanded view FIG. 4C portrays how the actuator wedge tension has allowed the saddle and screw assemblies to shift position within the larger housing screw cavities 33 producing gaps 34 essential for free movement of saddles 17 for adjustment.

Figure 5:
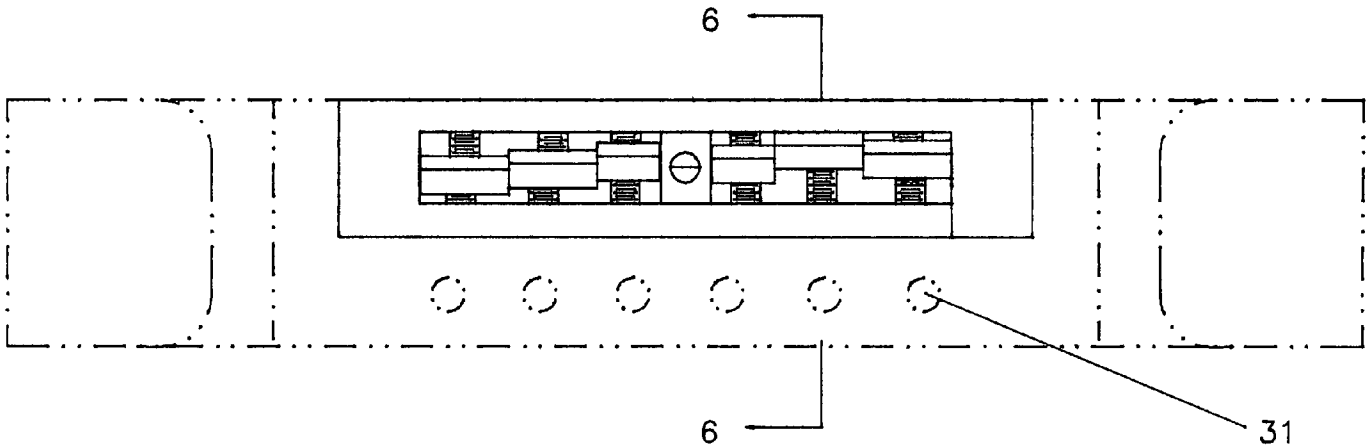
FIG. 5 Is a top side view of the invention incorporated within a bridge for a flat top guitar incorporating string retention holes.
Figure 7:
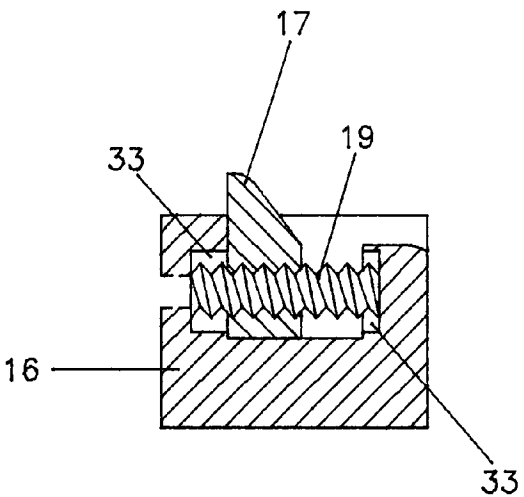
FIG. 7 Is an expanded view of FIG. 6 to show how the saddle screw is retained within the saddle housing screw cavities.
Figure 6:
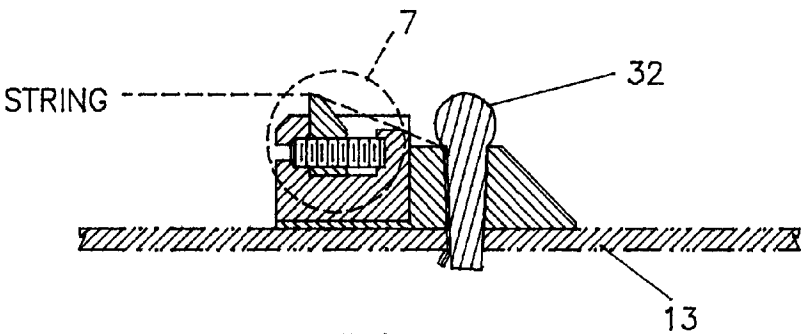
FIG. 6 Is a sectional right side view of invention incorporated in a conventional bridge with a sting installed.

FIG. 5 is a top side view of the preferred embodiment of the invention mounted in a conventional bridge 15. FIG. 6 is a right side view showing how the invention's saddle housing 16 is mounted in a cavity within a bridge 15, a tensioned string 23 passes over saddle 17 and is anchored to the instrument by passing through the bridge pin hole 31 and retained in place by bridge pin 32. The tension in string 23 produces a counter clockwise torque that has a downward component which presses saddle 17 against the basal portion of the saddle housing 16, producing vertical central alignment of screw 19 in the saddle housing's screw cavity 33 as shown in FIG. 7.

Operation

With the strings tensioned and passing over the saddles 17 the pressure on the actuator wedge 27 (FIG. 3) is released by loosening screw 26 allowing the actuator wedge to be withdrawn (FIG. 3A) enough to produce sufficient looseness to enable free movement of the saddles 17 for adjustment. The saddles 17 are individually adjusted by inserting a tool through access hole 29 to engage saddle screw 19. Each saddle 17 is adjusted by use of its saddle screw 19 which engages the threaded portion of the saddle, rotating the tool engaged with the saddle screw 19 provides precise movement of saddle 17 which is adjusted until the desired saddle position is achieved, i.e., one that produces correct string intonation. After each saddle is correctly adjusted they are arrested in position by tightening screw 26 which forces the actuator wedge 27 downwards whose slanted sides slidably engage similar slanted surfaces present on the adjacent saddles 17, biasingly urging the saddle array into firm contact with each other and the ends of the saddle housing 16.

FIGS. 8-12

Additional Embodiments

Figure 8:
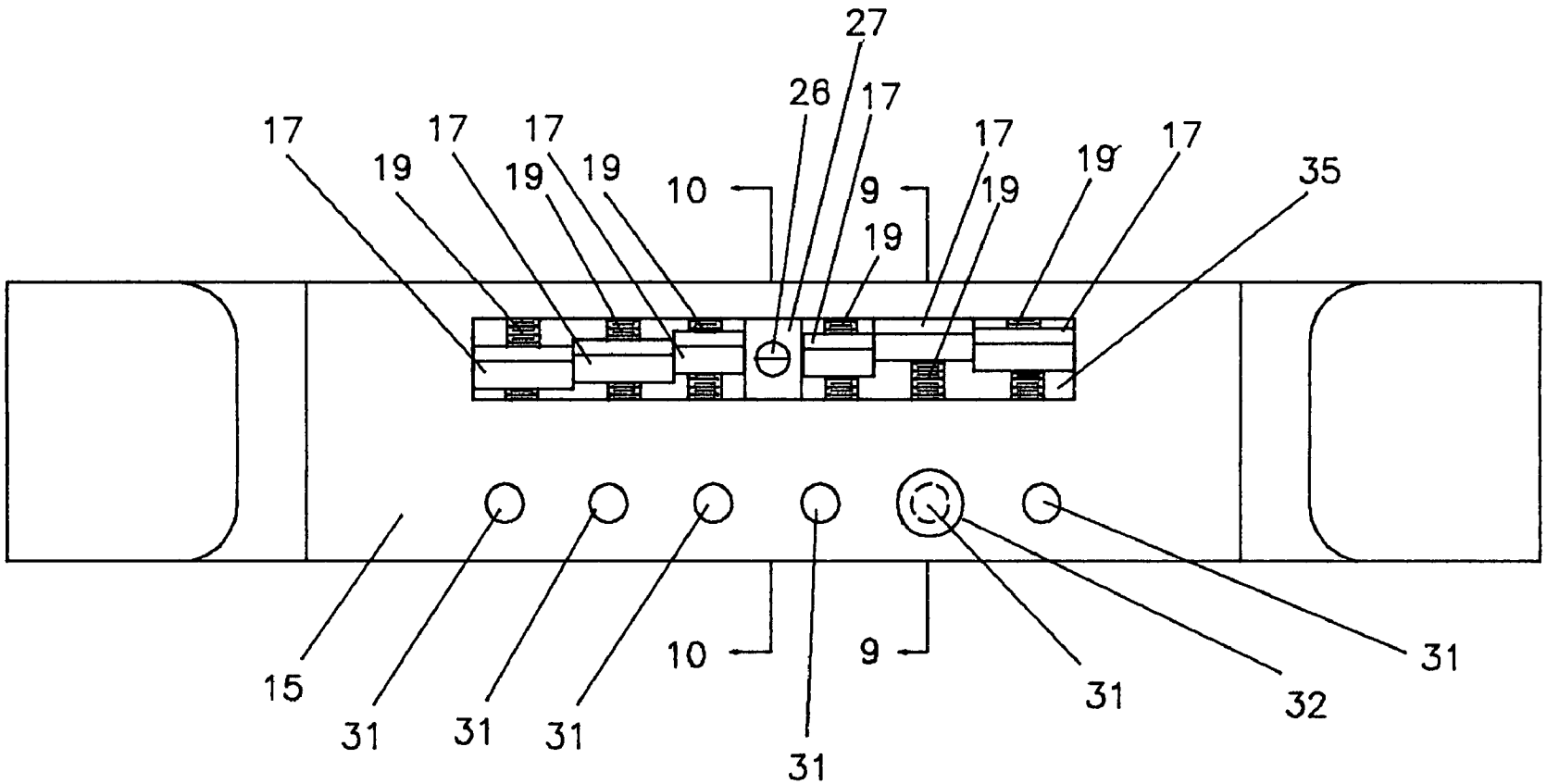
FIG. 8 Is a top side view of a second embodiment of the invention where the saddle housing is an integral part of the bridge.
Figure 9:
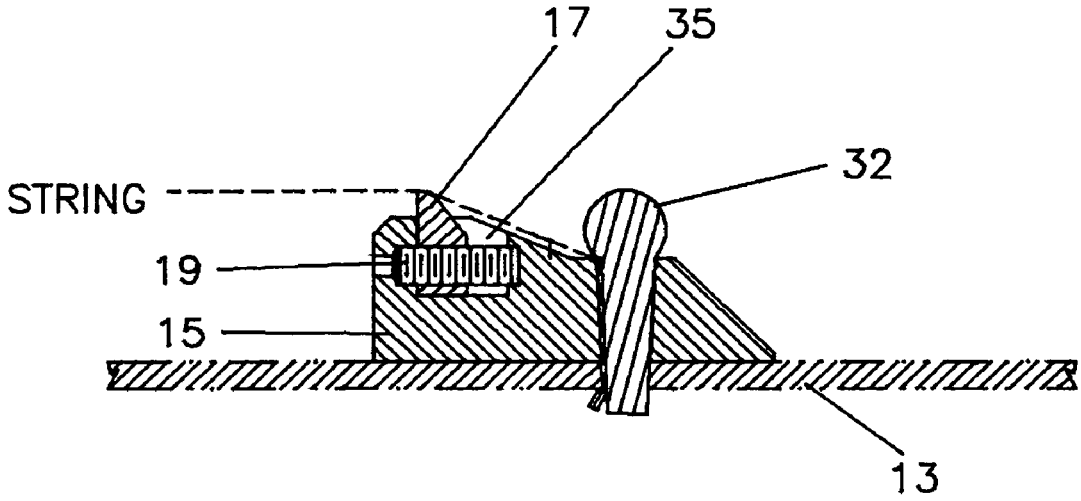
FIG. 9 Is a right side sectional view of FIG. 8, the sectioning plane passing through a saddle, saddle screw, and saddle housing.
Figure 10:
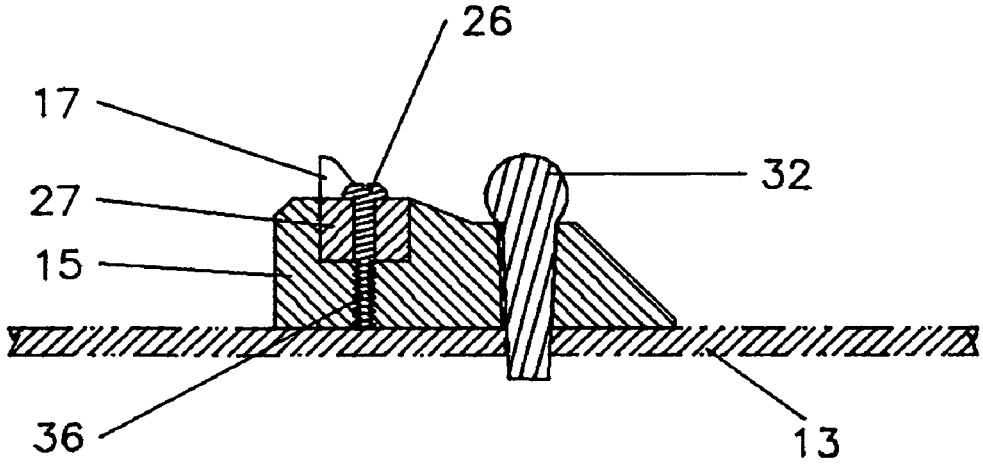
FIG. 10 Is a right side sectional view of FIG. 8, the sectioning plane passing through the wedge, tensioning screw, and a mating hole in the bridge base.
Figure 11:
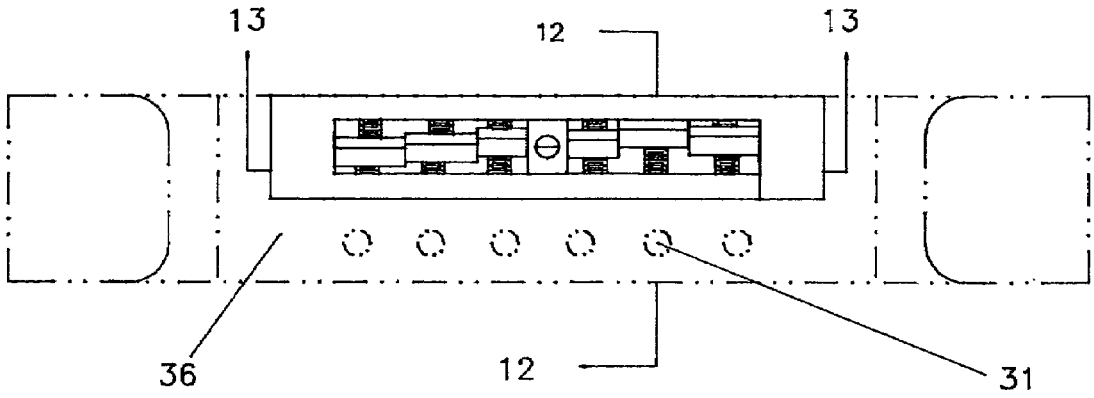
FIG. 11 Is a top side view of a third embodiment of the invention where the bridge incorporates a saddle housing with no integral basal element. The bottom of the bridge cavity providing the basal element.
Figure 12:
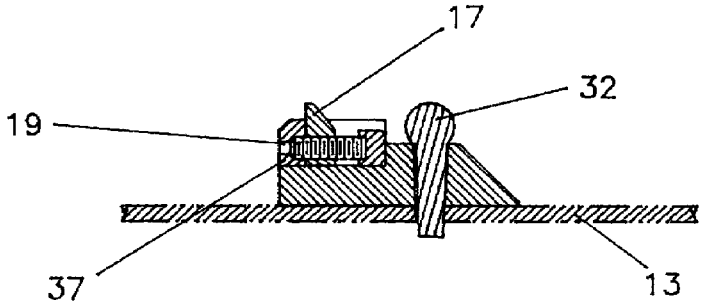
FIG. 12 Is a sectional right side view of FIG. 11 showing the invention mounted within a bridge cavity.
Figure 13:
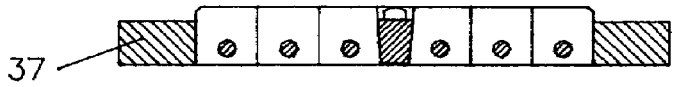
FIG. 13 Is a sectional back side view of FIG. 11 with the sectioning plane passing between the back wall and the saddles.
Figure 14:
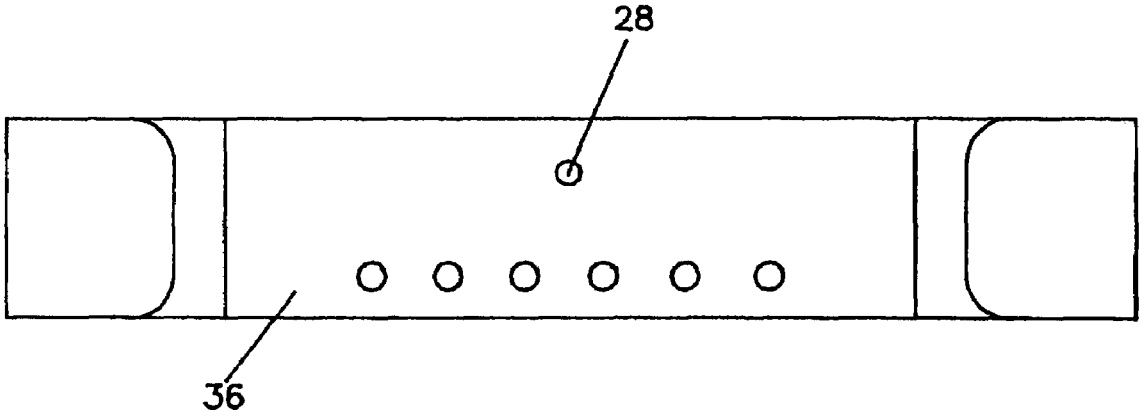
FIG. 14 Is a bottom side view of a bridge base for use with the nonpreferred embodiments showing a threaded hole.

Several additional embodiments are described in FIGS. 8, 9, 10, 11, 12, 13 and 14. In both cases the saddle housing configuration has been modified. The internal structure and method of operation remains the same as already described above. In the first case FIGS. 8, 9, and 10 depicts a bridge 36 that directly incorporates a bridge cavity 35 in its structure eliminating the need for a separate saddle housing. FIG. 8 is a top side view of the invention bridge base 36 that incorporates bridge cavity 35 which retains the same type of saddle mechanism FIG. 9 and arresting system FIG. 10 as has already been described for the preferred embodiment. However, in FIG. 10 screw 26 used to tension actuator wedge 27 now engages threaded hole 30 incorporated into bridge base 36. The second case FIG. 11 shows a 4 sided saddle housing 37 is incorporated in a bridge 15 which is providing the basal support for the saddles FIG. 12. The 4 sided saddle housing 37 is essentially a rectangular tube with a wall profile as illustrated in the back side sectional view displayed in FIG. 13. The actuator wedge 27 being tensioned by a screw passing through it and directly into a threaded hole underneath it in the bridge base (FIG. 14).

Advantages

From the description above, a number of advantages of my adjustable bridge system becomes evident:

(a) The invention provides independently and easily adjustable string support saddles to accomplish correct string intonation.
(b) It can be produced from acoustically resonant materials to preserve sonority.
(c) It can efficiently transfer string energy to the sound board of the instrument enabling production of maximum sound volume.
(d) It can increase the duration of the sound produced by a stimulated string.
(e) The saddles can be retained in place precluding any undesirable motion or change in position.
(f) Existing instruments can be retrofitted.
(g) It can be incorporated in new instruments.
(h) It is practical and inexpensive to manufacture.
(I) It is compatible with any conventional style of guitar bridge, i.e., for flat top and arch top instruments.
(j) It can be used for a broad range of lateral string spacings.
(k) It can be used with any string type.
(l) It's appearance is not radically different from conventional bridges.
(m) It can be produced in a number of embodiments to satisfy diverse customer requirements.

CONCLUSION, RAMIFICATIONS, AND SCOPE

Accordingly the reader will see that the adjustable bridge mechanism of this invention can be used to easily and efficiently produce optimal string intonation, preserve sonority, augment sustain, and produce increased sound amplitude in fretted stringed instruments. In addition, it can be utilized for new or retrofitted into existing instruments.

It can be wholly or partially produced from composite, polymer, or natural materials, i.e., in either homogenous or heterogenous configurations determined by the requirements of the end user.

The preferred embodiment and tubular style can be incorporated into bridges that are already mounted to existing instruments by simply cutting a appropriate cavity to mount either type, however, for the tubular style (FIGS. 11-13) an additional threaded hole for the wedge tensioning screw is required in the bridge base.

The tubular style is useful for applications where the saddle height above the sound board is lower than the normal range.

The embodiment where the housing cavity is incorporated in the bridge base (FIGS. 8-10) is useful for applications where its desired to mount an entire bridge assembly on an instrument. It also incorporates fewer parts than the other two variants.

It can be inexpensively produced by utilization of conventional molding or fabricating techniques.

Although the description above contains many specificities, these should not be construed as limiting the scope of the invention but as merely providing illustrations of some of the presently preferred embodiments of this invention. For example, it could be utilized on other types of fretted instruments such as banjoes, mandolins, lutes, and the like.

Thus, the scope of the invention should be determined by the appended claims and their legal equivalents, rather than by the examples given.

The invention claimed is:

1. An adjustable acoustic stringed instrument bridge comprising:

a. a saddle housing surrounding a plurality of adjustable saddles, a plurality of internally retained saddle screws, and an actuator wedge,
b. said saddle housing incorporating a plurality of housing screw cavities within the inner surfaces of its vertical walls comprising opposing pairs aligned with the longitudinal axis of a string,
c. said saddle housing incorporating a plurality of access holes penetrating through one of the upright walls of said saddle housing into one of each pair of said housing screw cavities centrally and longitudinally aligned with said housing screw cavity axis,
d. said saddles incorporating a threaded saddle hole,
e. said threaded saddle hole threadedly incorporating said saddle screw of sufficient length to be retained by said housing screw cavities,
f. said saddle occupying a position between said screw ends,
g. each of said screw ends being partially encapsulated within said housing screw cavities thereby loosely retaining and aligning said screw and saddle within said saddle housing along the longitudinal axis of the string,
h. said saddles being longitudinally adjustable along the string axis by means of said screw by a tool inserted through the access hole penetrating through the saddle housing wall, i. said actuator wedge providing a means of altering the lateral position of said saddles by slidably engaging contiguous slanted surfaces present on adjacent surfaces of said saddles, j. said saddles being able to be retained in fixed positions by means of said actuator wedge laterally displacing said saddles into firm contact with each other and the contiguous upright walls of said saddle housing, and l. said saddle screws being centrally positioned within said saddle screw cavities when said saddles are retained in fixed positions, thereby, isolating said saddle screws from contact with said saddle housing.

* * * * *